US006567001B1

(12) United States Patent
Barrieau et al.

(10) Patent No.: US 6,567,001 B1
(45) Date of Patent: May 20, 2003

(54) FIRE CONTROL PANEL MONITORING FOR DEGRADATION OF WIRING INTEGRITY DURING ALARM STATE

(75) Inventors: Mark P. Barrieau, Baldwinville, MA (US); Jeff Brooks, Ashburnham, MA (US); Anthony J. Capowski, Westford, MA (US)

(73) Assignee: Simplex Time Recorder Co., Westminster, MA (US)

( * ) Notice: Subject to any disclaimer, the term of this patent is extended or adjusted under 35 U.S.C. 154(b) by 0 days.

(21) Appl. No.: 09/511,944

(22) Filed: Feb. 24, 2000

(51) Int. Cl.[7] ..... G08B 29/00

(52) U.S. Cl. ..... 340/506; 340/507; 340/533; 340/3.1

(58) Field of Search ..... 340/506, 507, 340/511, 531, 533, 3.1

(56) References Cited

U.S. PATENT DOCUMENTS

| | | | | |
|---|---|---|---|---|
| 3,665,461 A | | 5/1972 | Gnägi et al. | 340/409 |
| 3,716,834 A | | 2/1973 | Adams | 340/147 |
| 4,088,986 A | | 5/1978 | Boucher | 340/237 |
| 4,101,887 A | | 7/1978 | Osborne | 340/652 |
| 4,191,946 A | | 3/1980 | Knox et al. | 340/506 |
| 4,474,825 A | | 10/1984 | Schmidt | 427/10 |
| 4,520,348 A | | 5/1985 | Swanson | 340/508 |
| 4,529,970 A | * | 7/1985 | Wynne | 340/506 |
| 4,551,671 A | | 11/1985 | Annunziata et al. | 324/51 |
| 4,639,719 A | | 1/1987 | Pappano et al. | 340/652 |
| 4,752,698 A | | 6/1988 | Furuyama et al. | 307/116 |
| 4,782,300 A | | 11/1988 | Bonaccio et al. | 324/509 |
| 4,796,025 A | | 1/1989 | Farley et al. | 340/825.08 |
| 5,105,426 A | | 4/1992 | Hagiwara | 371/20.1 |
| 5,179,341 A | | 1/1993 | Whiteside | 324/523 |
| 5,207,276 A | | 5/1993 | Scofield | 169/61 |
| 5,355,026 A | | 10/1994 | Scofield | 307/117 |
| 5,767,781 A | | 6/1998 | Yavelberg | 340/661 |
| 5,966,002 A | | 10/1999 | Barrieau | 323/222 |

* cited by examiner

*Primary Examiner*—Daryl Pope
(74) *Attorney, Agent, or Firm*—Hamilton Brook Smith & Reynolds, P.C.

(57) ABSTRACT

An alarm system includes a plurality of alarm devices connected to a load sensor. The load sensor senses the electrical load in the alarm system and indicates both the failure of the alarm devices in the system and the likely location of the failed devices.

17 Claims, 3 Drawing Sheets

FIRE CONTROL PANEL MONITORING FOR DEGRADATION OF WIRING INTEGRITY DURING ALARM STATE

BACKGROUND OF THE INVENTION

In a typical alarm system within a building, such as a fire or burglar alarm system, many types of sensors, detectors, lights, strobes, sounders and other associated devices may be located throughout the building as part of the system. Groups of these devices are often wired together along one or more pairs of electrical lines used to supply power and communications to the devices. A group of such devices wired on a commonly shared pair of lines is often referred to as a line of devices. Many separate lines of devices typically connect back to a control panel that controls the overall operation of the alarm system. A line of devices is usually associated with a certain zone of the building and/or a certain type of device. For example, one floor of a multi-story building may have all of its smoke detectors wired together on a line that connects back to the control panel.

In the alarm system, it is important to monitor the integrity of the line of devices to ensure that, in the case of an emergency, the devices will function properly. Such monitoring has been performed in the prior art using a supervisory current, as illustrated in FIG. 1.

An alarm system is provided generally as 10. The system 10 has a plurality of alarm devices 12-1, 12-2, 12-3, 12-4 electrically and alternately connected to a first voltage source 14 and a second voltage source 26, and to respective zero volt connectors 44 and 28, by electrical conductor 16. The alarm devices 12-1 through 12-4 are wired together in a parallel configuration. The system 10 also includes a first switch 18 and a second switch 20. Each switch 18, 20 can determine which source 14, 26 will power the alarm system 10.

The wiring integrity of the system 10 can be monitored in a supervisory state. When the system 10 monitors the integrity of the alarm devices 12 and electrical conductors 16 in a supervisory state, the first switch 18 engages an up position 22 while the second switch 20 engages a down position 42. Such contacting of the switches 18, 20 allows a supervisory current to travel from the first source 14 to a first zero volt connection 28. From the first voltage source 14, the supervisory current travels through an end-of-line resistor 30 and through a resistor 32 prior to reaching the first zero volt connection 28. In the supervisory state, alarm devices 12-1, 12-2, 12-3, 12-4 are inactive and draw a minimal amount of current from the first voltage source 14.

The voltage across the resistor 32, which indicates the level of current through conductor 16, is monitored by a wire integrity sensor 34. If the voltage within the resistor 32 remains relatively constant, as compared to a reference voltage 36, a status signal can be sent to a controller 38 indicating a proper line integrity of the system 10. The controller 38 can then indicate to a user that the wiring of the system 10 contains no breaks. In the case where the voltage remains constant, the wire integrity sensor 34 can continue to monitor the voltage across the resistor 32. A voltage drop across the resistor 32, as compared to the reference voltage 36, can indicate a problem in the electrical conductors 16 which prevents current from flowing to the alarm devices. If the wire integrity sensor 34 detects a drop in the voltage within the resistor 32, the wire integrity sensor 34 sends a status signal to the controller 38, indicating that there is a break in the line integrity of the system 10. The controller 38 can then indicate to a user the existence of a break in the wiring integrity of the system 10.

During an alarm state, the first switch 18 engages in the down position 24 while the second switch 20 engages the up position 40. Contacting of the switches 18, 20 in this manner allows an alarm-mode current to travel from a second voltage source 26 to a second zero volt connection 44. The second voltage source provides 24 volts to the system 10. In an alarm state, the alarm devices 12-1, 12-2, 12-3, 12-4 are active and draw significant current from the second voltage source 26. Current from the second voltage source 26 travels through each alarm device 12-1, 12-2, 12-3, 12-4 and toward the second zero volt connection 44. To monitor the system 10 during an alarm state, the system 10 includes a monitor 46 and a fuse 50.

During an alarm state, the monitor 46 compares a measured voltage of the system 10 with a reference voltage 48 of approximately zero volts. In the case where the fuse 50 remains intact, the monitor 46 measures zero volts. The monitor 46, in detecting no difference between the measured voltage and the reference voltage 48, can then send a status signal to the controller 38 indicating that the fuse is intact.

In the case where one of the alarm devices 12-1 through 12-4 develops a short circuit during an alarm state, the alarm device will draw an increased amount of current, thereby leading to an over current situation in the system 10. The over current in the system 10, in turn, causes the fuse 50 to trip or blow. With the fuse tripped, the monitor 46 will measure 24 volts from the system 10 and compare this measured voltage to the reference voltage 48. In the case of a tripped fuse, the monitor 46, in detecting a difference between the measured voltage and the reference voltage 48, sends a status signal to the controller 38 to indicate a short circuit in one of the alarm devices 12-1 through 12-4. The controller 38, in turn, can indicate to a user the existence of a short circuit in one of the alarm devices. Monitoring of an alarm system 10 in this manner, during an alarm state, has been performed using the Simplex 4010 system (Simplex Time Recorder, Gardner, Mass.).

SUMMARY OF THE INVENTION

While the aforementioned monitors can determine line integrity during a supervisory state and a short circuit in an alarm device in an alarm state, the monitors do not indicate where in the system a break has occurred during a supervisory mode or whether a break has occurred in the alarm mode. The monitors also fail to indicate which alarms are inoperative due to a break in the wiring of the system or due to a failure of an alarm device. Information regarding the location of the break and the operability of the alarms can be useful to emergency personnel. Without alarm notification, occupants may remain in a building during an alarm state, for example. Knowledge of where a break in line integrity occurs can provide emergency personnel with information regarding which occupants should be personally warned of an alarm state in a building.

During a fire emergency in the aforementioned alarm systems, the electrical conductors and alarm devices themselves are subject to damage caused by a fire or the resulting heat. Certain types of Circuit Integrity wiring can withstand direct flame for up to two hours. The characteristics of the wire, however, will change with this exposure. For example, the resistance of the wire will increase when exposed to direct flame. With such a change in the wire, the alarms used to warn of the fire may become inoperative. The change in resistance of the wiring, leading to alarm failure, cannot be detected with the current alarm systems.

The present alarm system detects the failure of an alarm device connected to the system. The alarm system will also detect not only a break in the line integrity of the system, but the location of the break. Furthermore, the alarm system can detect the change in resistance of the wiring in the system caused by exposure to heat which, in turn, can predict the potential failure of an alarm system.

The alarm system can include an electrical conductor, a plurality of alarm devices powered from the electrical conductor and a load sensor which senses the electrical load on the electrical conductor to indicate failure of one or more devices. The electrical load measured by the load sensor is proportional to the number of alarm devices powered from the electrical conductor. A decrease in the electrical load of the system indicates failure of at least one alarm device. The alarm system can also include at least one wire integrity sensor to monitor for breaks in the electrical conductor during supervisory mode.

The plurality of alarm devices in the system can be notification appliances, such as audible devices or light strobes. The alarm devices can also be sensors, such as smoke or temperature sensors. The load sensor can measure either current in the electrical conductor, such as by sensing voltage across a resistor connected in series with the electrical conductor, during an alarm state and compare this measurement against a baseline or initial electrical load value. Any deviation between the initial load and measured load indicates failure of an alarm device. The initial electrical load in the alarm system can be measured during the initialization of the system. When the load sensor is active, during an alarm state, the sensor indicates the number of alarm devices active in the alarm system.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon, illustrating the principles of the invention.

DETAILED DESCRIPTION OF THE INVENTION

Figure 1:
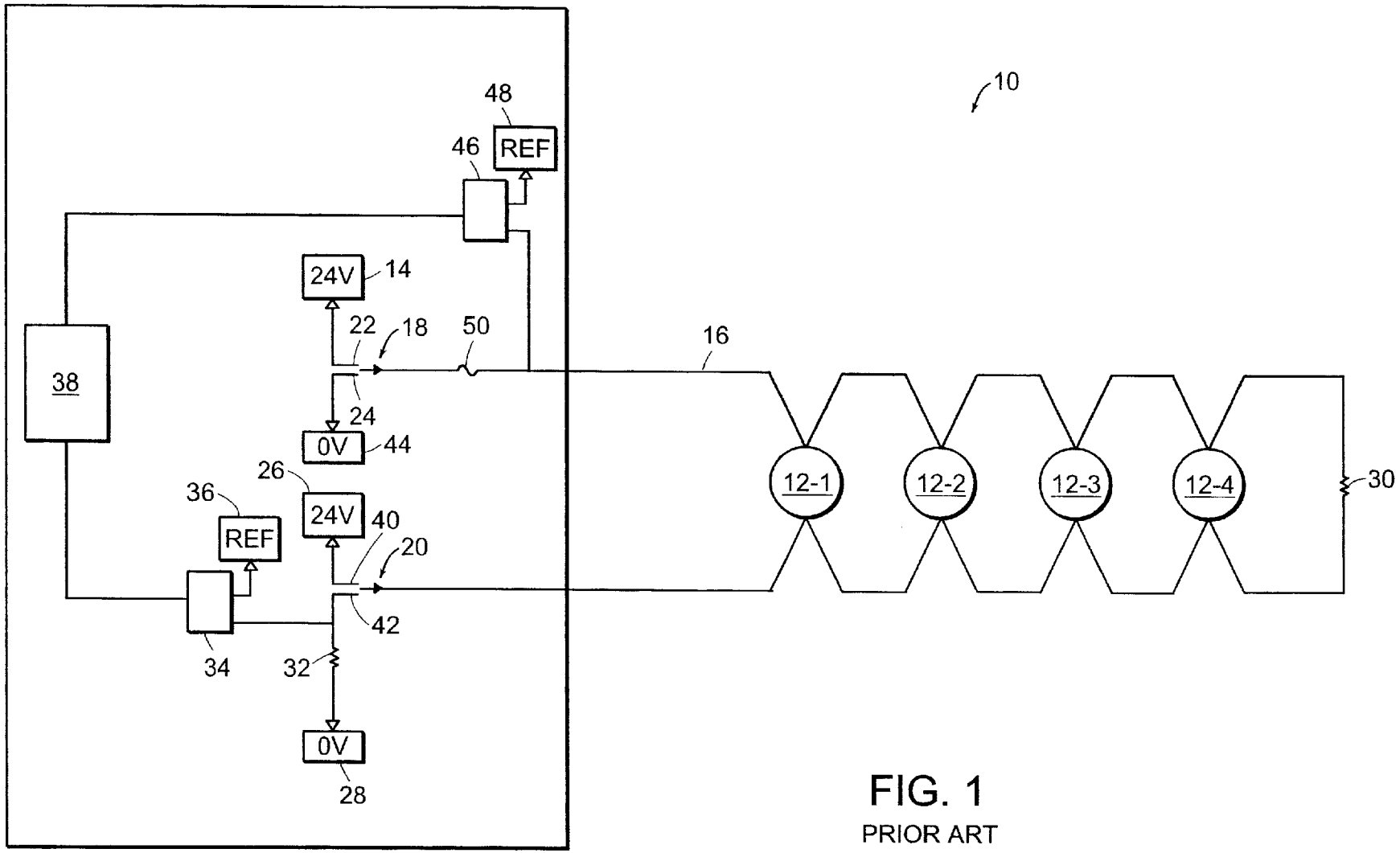
FIG. 1 PRIOR ART
FIG. 1 illustrates prior art line integrity monitoring for an alarm system.
Figure 2:
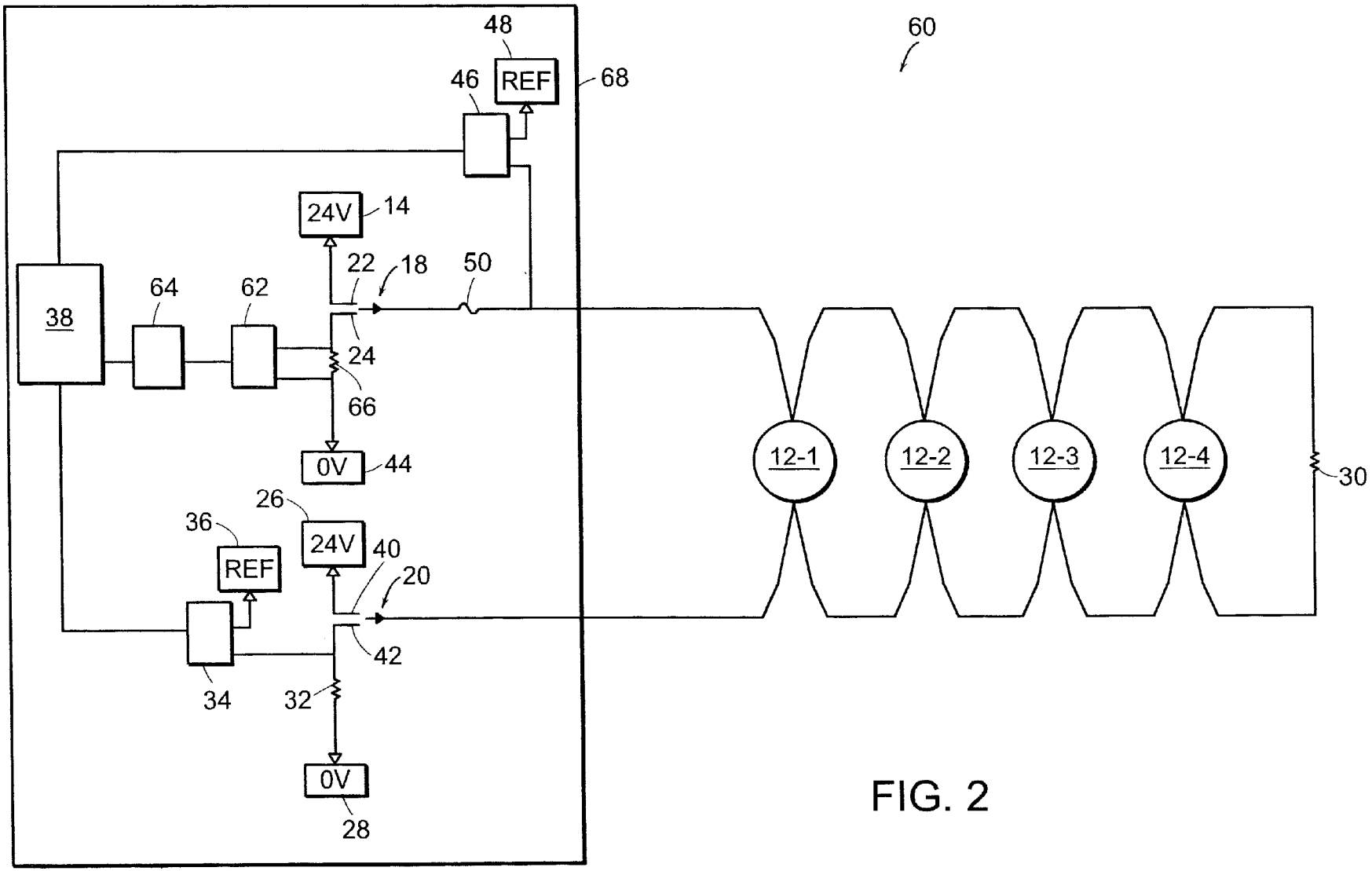
FIG. 2 illustrates a device for locating a break in line integrity for an alarm system in accordance with the invention.

FIG. 2 shows an alarm system, given generally as 60. The alarm system 60 has supervisory mode wire integrity sensor 34 and an alarm state monitor 46, as shown and described above. In accordance with the invention, the alarm system 60 also has a load sensor 62 which senses the load of the electric conductor 16. A change in the load on the conductor 16 during an alarm can indicate failure of one or more of the alarms 12-1 through 12-4 or can indicate a break in the conductor 16 somewhere in the system 10. The electrical load in the conductor 16 is proportional to the number of alarm devices powered from the conductor 16.

The load sensor 62 directly measures voltage across a resistor 66, in series with the conductor 16, to sense current in the conductor 16. Other current or power sensors can also be used. In order to properly monitor the load in the alarm system 60, the load sensor 62 compares a total expected amount of current drawn by the system 60 with a measured amount of current actually drawn by the system 60. The amount of total expected current drawn can be measured during the initiation or during a test of the system 60 and stored within the controller 38. A comparison of the baseline value to the measured value by the load sensor 62 will indicate any changes in the current drawn of the system 60. The total expected amount of current or voltage drawn by the alarms in the system 60 can also be determined mathematically based upon the current drawn by each individual alarm, and can be stored in the controller 38 as a baseline value. The load sensor 62 can be a differential amplifier attached across the resistor 66 and attached to an analog-to-digital (A/D) converter 64.

To illustrate the operation of the load sensor 62, assume that the load sensor 62 measures current in the alarm system 60 by monitoring the voltage drop across the resistor 66 and that the system 60 is in an alarm state. In an alarm-state, the first relay 18 engages a down position 24 while the second relay 20 engages an up position 40. The plurality of alarms 12-1, 12-2, 12-3, 12-4 draw significant current from the second voltage source 26 in this state. As current flows from the source 26 to zero volt connection 44, it travels through the resistor 66. The load sensor 62 measures the voltage drop across the resistor 66 and sends a corresponding voltage to the A/D converter 64, the output of which is read by the controller 38. The voltage sent to the A/D converter 62 represents the loop current within the system 60. The controller 38 compares the loop current of the system 60 with the baseline value stored in the controller 38. The baseline value represents the expected load current of the system 60.

Removal of one or more of the alarms 12-1 through 12-4 from the alarm system 60 will decrease the amount of current drawn by the system 60. The lower the current, the lower the voltage drop across the resistor 66. The voltage drop across the resistor 66, therefore, is proportioned to the loop current of the system 60. In the case where there is a change, or a difference between the loop current and the baseline value, beyond an expected tolerance, the controller 38 emits a warning signal to indicate failure or removal of one or more alarms from the system 60.

The wire integrity sensor 34, monitor 46, load sensor 62, A/D converter 64, controller 38 and associated switches 18, 20, resistors 32, 66 and fuse 50 can be located within a central base unit 68. Arranging all the aforementioned components in a base unit 68 provides a single convenient package for the user. The controller 38 can include a computer and a display. The display can be used to provide a visual warning in the case of a break in line integrity or in the case of failure of an alarm 12-1 through 12-4. The switches 18, 20 of the system can be relays, for example, and can be either mechanically or electronically activated. The alarm devices 12-1 through 12-4 of the system 60 can include notification appliances. The notification appliances can be either audible devices or light strobes, for example. While four alarms are shown attached to the alarm system 60, a plurality of alarm devices can be connected to the alarm system 60. The devices 12-1 through 12-4 can also be sensors, such as smoke sensors or temperature sensors, for example. When the devices 12-1 through 12-4 are sensors, monitoring of the electrical load in the alarm system 10 can be performed in a supervisory state.

Figure 3:
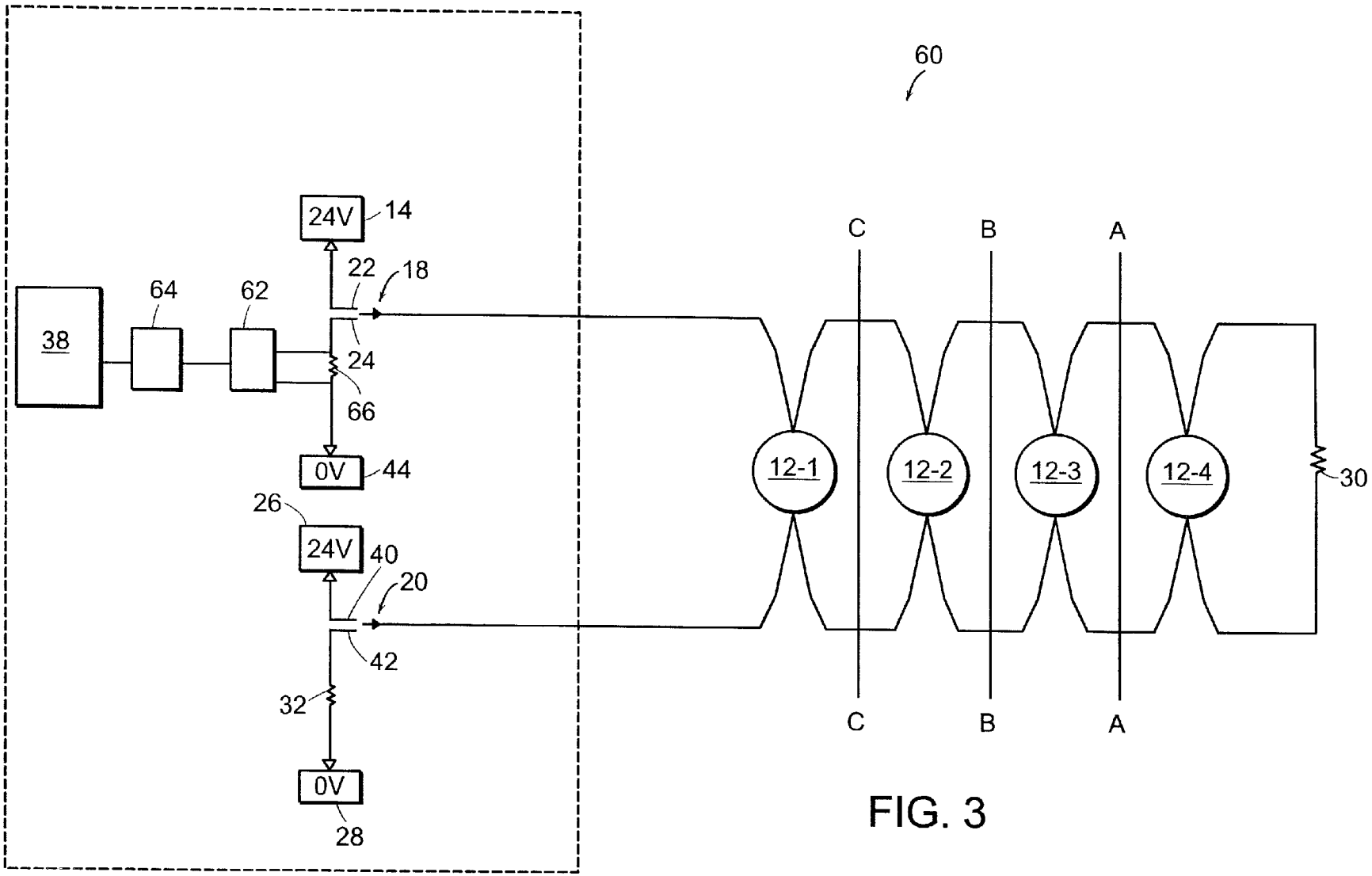
FIG. 3 shows an alarm system with breaks in line integrity at different points in the conductor.

The principle of monitoring a load in the alarm system 60 to determine where a failure or disconnection of an alarm has occurred is illustrated in FIG. 3. The alarms 12-1, 12-2, 12-3 and 12-4 are wired together in a parallel configuration within the system 10. Assume, for example, that the alarms 12-1, 12-2, 12-3, 12-4 have a total expected current draw of 4 amperes (A). The amount of current drawn by each alarm can be calculated by dividing the total expected amount of current drawn by the number of alarms attached to the system. Each alarm, therefore, draws approximately 1 A of current. Any failure or removal of one or more of the alarms 12-1 through 12-4 from the system 60 will result in varying decreases in the amount of current drawn by system 60. Such decreases, as monitored by the load sensor 62, can correspond to failing or disconnected alarms at various points along the system 60.

During an alarm state, the load sensor 62 measures the load in the system by monitoring the voltage drop across the resistor 66. For example, if the measured current in the system 60 decreases from 4 A to 3 A, the load sensor 62 measures the corresponding decrease in the voltage drop across the resistor 66 and reports the voltage drop to the controller 38. The controller 38 then compares the voltage corresponding to the measured current of 3 A to the baseline value of 4 A for current draw of the system 60. Determining that the system 60 is operating at 75% of capacity, the controller 38 can determine that an alarm device is no longer active and can provide a warning indicating such. The controller 38 can also indicate the number of alarm devices that are active in the system.

The controller 38, furthermore, can provide a warning as to the location of the failed alarm. Because each alarm in this system 60 draws 1 A of current and because the alarms are connected in a parallel wiring configuration, a decrease in loop current by approximately 1 A will correspond to the loss of one alarm which is likely at the end of the wiring chain. In this example, the controller can alert a user that alarm 12-4 is not properly connected to the system. The detachment of the alarm 12-4 can be caused either by the failure of the alarm 12-4 itself, as caused by fire or a malfunction, for example, or by a break in the conductor 16 of the system 60 along line A—A.

A decrease in the measured current within the system 60 from 4 A to 2 A, as determined by the load sensor 62, indicates the system 60 operating at 50%. A decrease in loop current by approximately 2 A will correspond to the loss of two of the four alarms at the end of the wiring chain. The loss of the two alarms can be caused by a malfunction of any two alarms or a break in the conductor along line B—B, more likely the latter. The controller 38 can indicate to a user that alarms 12-3 and 12-4 are likely not properly functioning or are not attached to the system.

A decrease in the measured current within the system 60 from 4 A to 1 A, as determined by the load sensor 62, indicates the system 60 operating at 25%. A decrease in loop current by approximately 3 A will correspond to the loss of three alarms, likely 12-2, 12-3 and 12-4 at the end of the wiring chain. The loss of the three alarms 12-2, 12-3 and 12-4 can be caused by a malfunction of all alarms 12-2,12-3 and 12-4 or a break in the conductor along line C—C. The controller 38 can also indicate to a user that all three alarms 12-2, 12-3 and 12-4 are disconnected from the system 60.

As shown, the load sensor 62 monitors the current or voltage of an alarm system 60 to determine the location of a failure of an alarm device. The load sensor 62 can also monitor for the possibility of alarm failure as caused by the application of fire to certain types of wiring attached to the alarms. Circuit Integrity wiring, for example, can withstand direct flame for up to two hours. However, the electrical resistance of the wire increases as it is exposed to the flame. An increase in the resistance of the wire or conductor 16 can lead to cessation of operation of the alarms and can alter the amount of current in the system 60, as monitored by the load sensor 62. Because the load sensor 62 monitors the current of the system 60, it can also detect the possibility of an alarm device failing as caused by exposure of the wiring to direct flame. As described above, the controller 38 provides a warning as to the location of the failing alarm within the system 60, based on the change in measured current within the system 60 with respect to the baseline current value of the system 60.

While this invention has been particularly shown and described with references to preferred embodiments thereof, it will be understood by those skilled in the art that various changes in form and details may be made therein without departing from the scope of the invention encompassed by the appended claims.

What is claimed is:

1. An alarm system comprising:

an electrical conductor;

a plurality of alarm devices powered from the electrical conductor; and a load sensor which, during an alarm state, senses the electrical load on the electrical conductor to indicate failure of one or more devices.

2. The alarm system of claim 1 wherein the load sensor senses current in the electrical conductor.

3. The alarm system of claim 1 wherein the load sensor senses voltage across a resistor in series with the electrical conductor.

4. The alarm system of claim 1 wherein the alarm system further comprises at least one wire integrity sensor which senses a break in the electrical conductor in a supervisory mode.

5. The alarm system of claim 1 wherein the alarm system further comprises at least one monitor which senses over current in the system during an alarm state.

6. The alarm system of claim 1 wherein the plurality of alarm devices comprise notification appliances.

7. The alarm system of claim 6 wherein the notification appliances comprise audible devices.

8. The alarm system of claim 6 wherein the notification appliances comprise light strobes.

9. The alarm system of claim 1 wherein the plurality of alarm devices comprise sensors.

10. The alarm system of claim 9 wherein the sensors comprise smoke sensors.

11. The alarm system of claim 9 wherein the sensors comprise temperature sensors.

12. The alarm system of claim 1 wherein the sensed electrical load is proportional to the number of alarm devices powered from the electrical conductor.

13. The alarm system of claim 1 wherein the load sensor senses multiple levels of current in the electrical conductor.

14. The alarm system of claim 1 further comprising a controller for warning of a location of the one or more failed devices.

15. A method of monitoring an alarm system comprising:

applying power to a plurality of alarm devices on a conductor, during an alarm state, monitoring an electrical load on the conductor; and indicating failure of one-or more alarm devices based on the electrical load.

16. The method of claim 15 further comprising measuring an initial electrical load in the alarm system during the initialization of the system and comparing the initial electrical load to the monitored electrical load.

17. The method of claim 15 further comprising indicating the number of alarm devices active in the alarm system.

* * * * *